US007172637B2

(12) United States Patent
Weissman et al.

(10) Patent No.: US 7,172,637 B2
(45) **Date of Patent: *Feb. 6, 2007**

(54) METHOD AND APPARATUS FOR PACKAGING CHARCOAL FUEL AND OTHER FUELS FOR EASY LIGHTING

(75) Inventors: Gregg D. Weissman, Los Gatos, CA (US); Jennifer J. Young, Los Gatos, CA (US)

(73) Assignee: Summit Views LLC., Los Gatos, CA (US)

( * ) Notice: Subject to any disclaimer, the term of this patent is extended or adjusted under 35 U.S.C. 154(b) by 193 days.

This patent is subject to a terminal disclaimer.

(21) Appl. No.: 10/461,648

(22) Filed: Jun. 13, 2003

(65) Prior Publication Data

US 2004/0035046 A1 Feb. 26, 2004

Related U.S. Application Data

(60) Provisional application No. 60/388,839, filed on Jun. 14, 2002.

(51) Int. Cl.
*C10L 5/00* (2006.01)

(52) U.S. Cl. ..... 44/541; 44/542; 44/544; 44/533; 44/530; 44/519

(58) Field of Classification Search ..... 44/519, 44/530, 540, 541, 542, 544, 533
See application file for complete search history.

(56) References Cited

U.S. PATENT DOCUMENTS 1,124,015 A 1/1915 Griffin
2,206,362 A * 7/1940 Mulcey ..... 44/541
2,240,335 A * 4/1941 Keil ..... 44/541
2,548,379 A 1/1951 Lammersen (Continued)

FOREIGN PATENT DOCUMENTS

CA 868164 A * 4/1971
ZA 8905643 A * 4/1990

OTHER PUBLICATIONS de Hoop, Cornelis F., *Assessment of Air Emissions of Environmentally Friendly Firelogs from Agricultural and Wood Residues*, Southeastern Regional biomass Energy Program, Aug. 21, 1998.

(Continued)

*Primary Examiner*—Cephia D. Toomer
(74) *Attorney, Agent, or Firm*—Marshall, Gerstein & Borun LLP

(57) ABSTRACT

A combustible charcoal fuel package is disclosed which includes an outer wrapper, preferably formed from burlap or other similar woven material that encloses large pieces of charcoal material, medium pieces of charcoal material and smaller pieces of charcoal material coated or otherwise soaked in a vegetable wax to form an aggregate. The aggregate is disposed at or near the bottom of the burlap wrapper, with the medium-size pieces of charcoal material disposed thereon with the larger pieces of charcoal material disposed on top of the medium-sized pieces of charcoal material. Preferably, all charcoal materials are fabricated from all-natural charcoal logs fabricated from compressed charcoal particles without the use of odor causing binders.

17 Claims, 7 Drawing Sheets

U.S. PATENT DOCUMENTS

| | | | | | |
|---|---|---|---|---|---|
| 2,666,695 | A | | 1/1954 | Brody | |
| 2,799,563 | A | | 7/1957 | Shenker | |
| 2,963,352 | A | | 12/1960 | Davis | |
| 3,252,770 | A | | 5/1966 | Fearon | |
| 3,269,807 | A | | 8/1966 | Key, Jr. | |
| 3,431,093 | A | * | 3/1969 | Kreinik | 44/542 |
| 3,726,652 | A | * | 4/1973 | Schick | 44/533 |
| 4,775,391 | A | | 10/1988 | Antosko | |
| 5,421,836 | A | | 6/1995 | Ross | |
| 5,456,732 | A | | 10/1995 | Baxter | |
| 5,626,636 | A | | 5/1997 | Carter | |
| 2002/0129808 | A1 | * | 9/2002 | Manner | 126/45 |

OTHER PUBLICATIONS

Houston, Jr., James T., *The Development of a Firelog with Improved Air Emissions,*A Thesis, Dec., 1999.

Barnett, Stockton G., et al., *In-Home Demonstration of the Reduction of Woodstove Emissions from the Use of Densified Logs,*OMNI Environmental Services, Inc.

Houck, James E., et al., *Convenience Fuels*, Health and Home, 4 pages, Dec., 2001.

Website information regarding *Eucalyptus Enviro-Log* from www.american-eucalyptus.com, 1 page, May 20, 2003.

Webstite information regarding *Blue Mountain Logs* from www.firelogs.net, pp. 1-4, May 20, 2003.

Website information regarding *Pres-to Logs* from www.lignetics.com, 1 page, May 20, 2003.

Website information regarding *WiseWood Firelogs* from www.worldwise.com, 3 pages, May 20, 2003.

* cited by examiner

METHOD AND APPARATUS FOR PACKAGING CHARCOAL FUEL AND OTHER FUELS FOR EASY LIGHTING

CROSS-REFERENCE TO RELATED APPLICATION

This application claims the benefit under 35 U.S.C. 119(e) of U.S. provisional patent application Ser. No. 60/388,839 filed Jun. 14, 2002, the disclosure of which is incorporated herein by reference.

TECHNICAL FIELD OF THE DISCLOSURE

Fuel packages such as wood firelog fuel packages and charcoal fuel packages that consumers may easily ignite are disclosed and methods of utilizing the same are disclosed.

BACKGROUND OF THE DISCLOSURE

Fuel packages have traditionally been available to consumers as charcoal fuel and wood firelog fuel. These combustible fuel packages are commonly used both for home and recreational purposes. Such fuel packages have experienced great popularity in recent years and are strongly desired for a variety of purposes, especially cooking and heat-generation, for example.

With respect to charcoal fuel packages, petroleum lighter fluids may be used with easy-lighting charcoals, the coal dust and filler materials in charcoal briquettes, and wood firelogs. However, these petroleum lighter fluids are harmful to the environment, can soil the consumer or his/her clothing, and are relatively dangerous to use or store due to their flammability.

There are many brands and varieties of cooking charcoal on the market, such as briquettes, chunk charcoal, and variations that contain petroleum based lighter fluid to allow lighting without the need for other starting apparatus. There are also charcoal brands which ignite easily by utilizing a paper packaging in combination with a petroleum starter that is lit in several places causing the charcoal to ignite.

A product and method is needed that combines the ease-of-lighting charcoal made using flammable petroleum based binding materials and accelerants, with the cleanliness and desirability of an all-natural product associated with the packaging to create a "one-match" ignition of natural chunk charcoal. It would be advantageous to avoid or eliminate the use of petroleum based lighter fluids as well.

Another wood fuel used in the art is wood firelogs. Wood firelogs are commonly produced as compressed or all-wood firelogs. There are many types of compressed firelogs on the market made from sawdust, sawdust-and-wax mixtures, recycled cardboard and other similar materials.

Well-known compressed sawdust-and-wax firelogs are commonly sold in grocery stores under various trade-names such as "Duraflame" and "Pine Mountain." These compressed sawdust-and-wax firelogs ignite easily because they are covered in paper that may be lit in several places. Once the paper covering is lit, the paper then ignites the firelog, which itself has a low combustion threshold due to the presence of flammable petroleum wax materials that typically constitutes 50% to 60% of these firelogs.

Many consumers avoid using petroleum wax with the sawdust-and-wax firelog and seek more natural products made with just pure sawdust or other suitable vegetation material. These firelogs are made by a fundamentally different process than the wax variety of firelog, as the process uses extremely high pressure to cause a chemical fusing of the lignin in the wood, resulting in the bonding of the material into a solid log unit without the adhesive and binding characteristics of wax or other foreign materials. While this has the advantages of creating a solid log without binding agents, it also increases the combustion threshold of the log, making it difficult to light.

When such firelogs are burned, it is only wood material burning and many consumers prefer the resulting fire from the standpoint of ecological concerns, odor and other esthetics, as well as the controllability of an all-wood fire as opposed to a fire maintained mostly by the combustion of wax. Wax-containing logs come with warnings not to poke them when burning, and not to burn more than one at a time, because of the problems with flaring of the wax. Wax logs have also been known to explode in fireplaces.

Often wood firelogs may be difficult to light because of the denseness of the material, which may prohibit timely combustion. Various brands of wood firelogs provide manufacturers' directions that involve chopping chunks off a firelog, and using kindling to light those chunks, all in order to light the full firelog. This process might work provided the amount of additional kindling is sufficient to ignite the chunks. However, this process often requires "standard fire-building" in situations when the manufacture's instructions fail. "Standard fire-building" typically requires placing paper or other kindling and small pieces of dry wood around the full log in order to achieve ignition. Standard fire-building may also involve the use of newspaper, kindling and/or flammable fire starters that can create an unpleasant odor, especially when used indoors.

It is therefore a desirable to combine the easy-lighting characteristics of the wax-based firelog with the pure wood-content only firelog. As noted above, lighting an all-wood firelog is not easy. Existing brands of all-wood firelogs come with multi-step instruction sheets requiring the person desiring a fire to chop up portions of the log, position the chopped portions in a specific arrangement with respect to the whole logs, and place additional kindling around or beneath the wood firelogs. Despite following these instructions, the logs may not always light.

Therefore, there is a need for a wood fuel package that facilitates a "one-match" ignition without requiring additional effort by the consumer like standard fire-building.

SUMMARY OF THE DISCLOSURE

The packaged wood fuels, both charcoal fuel and wood firelog fuels, disclosed herein afford easy lighting, using clean and renewable-resource packaging materials without recourse to undesirable ingredients such as petrochemicals and processed paper, and present a more attractive appearance than usually associated with traditionally packaged wood fuels.

The disclosed methods and packages provide for quick lighting of chunk charcoal, while avoiding those undesirable materials. The disclosed methods and packages combine the ease-of-lighting of charcoal made using flammable petroleum-based binding materials and accelerants, with the cleanliness and desirability of an all-natural product comprised only of chunks of charcoal and a minimum of other natural material to ignite the charcoal, associated with the packaging.

The disclosed methods and packages provide a "one-match" ignition for wood fuels like charcoal and wood firelogs. A "one-match" ignition is an ignition that requires minimal effort by the consumer. With respect to wood firelogs, various approaches attempted to achieve "one-match" ignition have addressed the lighting of composite logs, but not pure-wood firelogs. The disclosed method is capable of very quickly lighting pure-wood logs.

This disclosure adapts and extends the methods and apparatuses described in the provisional and non-provisional patent applications entitled "Method and Apparatus for Packaging Compressed Wood Firelogs" (Application. Ser. No. 60/326,110, filed Oct. 1, 2001) (application Ser. No. 10/261,350, filed Oct. 1, 20012) the disclosure of which is expressly incorporated herein by reference, to use chunk charcoal material as an additional embodiment to the firelog material as described in that application, while adding a novel feature to the disclosure in the form of an inner covering, like a bag or wrapper.

One aspect of the products disclosed herein is to keep all materials used as natural as possible, as the desire is to have a result that is superior with respect to the naturalness and renewable-resource characteristics of the ingredients compared to solutions requiring petroleum products such as waxes, plastics or processed papers. The disclosed products use the wood fuel itself for the wood component and should not require external tinder, kindling, or similar material. In addition to this packaging, it is important to the consumer to keep all materials as natural as possible. For instance, naturally occurring wood kindling may not be burned because of regulations. Also, using natural materials lowers the cost to make a wood fuel product, and may be cheaper for the consumer.

The disclosed methods and packages provide a complete package that allows the wood fuel ignition without requiring the consumer to undertake standard fire-building techniques.

One embodiment of the disclosed product utilizes an outer burlap covering made from jute, hemp, or other organic fiber in a loose weave. The burlap outer covering encompasses the wood fuel and easily ties. In the case of wood firelog fuels, the outer burlap covering encompasses crushed and chopped portions of a firelog in such a proportion as to induce first the ignition of smaller portions, and then larger chunks of broken and chopped firelog. The heat of the burning firelog pieces, being made from the same material as the main firelog, becomes sufficient to ignite an entire log, and provide a pleasing natural-looking fire experience without the need to manually chop, stack, arrange, and kindle some arrangement of material. The use of burlap as an embodiment for containing a collection of firelog chunks also aids combustion and provides additional benefits. The combustibility of the burlap, combined with its ability to be formed easily into a covering-like item, together with its low cost and ubiquity, and its "all-natural" content and image, used as a container for a variegated mixture of compressed-sawdust firelog pieces, allows the creation of a very effective, clean-burning, and instant method of lighting the firelog. This above embodiment is likewise applicable to charcoal fuel as well.

Another embodiment includes an additional feature, an all-natural vegetable wax made from soybeans or an equivalent. When applied to firelogs, the all-natural vegetable wax enhances the reliability of starting the fire, and avoids usage of petroleum-based products. While the prior art includes use of wax and wood elements as an aid to fire-lighting, the overall combination of the elements in the disclosure is unique in its effectiveness, cleanliness, and convenience for the consumer.

The all-natural vegetable wax may also be used with charcoal embodiments. Small chunks of charcoal are included in the tied burlap covering, along with some larger chunks, and then finally the largest chunks. The charcoal may be traditional coal-based chunks or hardwood charcoal. The gradation in size of charcoal pieces may be such that the smallest chunks when ignited from the burning of the burlap covering, ignite the larger chunks, and then ignite the largest chunks. The disclosed product improves over charcoals that use petroleum accelerants to ignite, or other petrochemical-based ingredients in the packaging as an aid to ignition.

Additional embodiments include an inner covering that may be nearly impermeable to the small particles of firelog, wax, and charcoal, yet can still be easily burned. Charcoal easily powders and flakes causing unwanted charcoal dust to permeate the loosely woven burlap. The inner covering in these charcoal embodiments prevent this permeation problem. Additionally, with respect to firelog embodiments, even though only chunks, chips and wafers of firelog material are being packaged, sawdust and small wax bits may come off the material inside the covering and come out of the loose burlap weave. A tighter weave of burlap covering might be more difficult to ignite and could restrict airflow to the extent that ignition of the wood fuel would be inhibited. Both charcoal and firelog embodiments use renewable organic materials that should not be derived from petrochemicals, and should be nontoxic when burned.

The inner covering as used in both charcoal and firelog embodiments of the product should be flexible and strong, yet lightweight, burn easily, be free of petrochemicals, and be made from renewable resources. The inner covering may be made from polymerized cornstarch, which is biodegradable, and designed for disposal by incineration. An example of this biodegradable material is "Mater-bi," a well-developed product in Europe, which is typically imported into the United States. Additional examples of the inner covering may include, a porous non-paper flammable fiber covering such as corn husking, banana leaves, papyrus, or similar material.

By creating a combination of small charcoal chips coated with soy-wax and larger charcoal chunks—all contained inside a combustible inner covering, which may be comprised of an all-natural cornstarch polymer—within an outer burlap covering, the resulting charcoal embodiments are a single packaged product. When lit, this arrangement enables the charcoal to ignite and burn without an external apparatus and recourse to undesirable materials. Similarly, by creating a combination of small firelog chips and chunks coated with soy wax, larger firelog wafers, and firelogs, all contained in an inner combustible covering comprised of an all-natural cornstarch material, itself contained within an outer burlap covering, the resulting firelog embodiments are a single product. When lit, this arrangement enables firelogs to ignite and burn without any external kindling or skill on the part of the consumer, and without recourse to undesirable materials Some disclosed methods directed to both charcoal and wood firelogs products involve the application of a small amount of vegetable wax accelerant, like soy wax, to the firelog chip and wafer starter material, or to charcoal chips and chunks starter materials.

Another embodiment directed to both charcoal and firelogs involves the use of a natural-fiber cloth wicking material impregnated with a vegetable wax accelerant, like soy wax, instead of applying all the starter material to the wood fuel components. This can be a preferable manufacturing method as it is a simpler method in many cases to cause the cloth wicking material to become infused with the soy wax than it is to apply the soy wax to the wood fuel. The natural fiber uses all-natural renewable-resource materials in accordance with the goals of the product and burns cleanly. An alternative embodiment to cloth wicking may also be the same or different burlap material as used in the outer covering.

Another embodiment directed to both charcoal and firelogs involves the use of small (1 inch and below in length), clean, dry (below 25% moisture) hardwood chips such as are obtained by hardwood tree disposal chipping and grinding operations in addition to the firelog wood chips and wafers, or, in the case of charcoal, in addition to the smallest of the charcoal pieces. This chip material can then be impregnated with the soy wax accelerant by dipping about an 8 oz. to 12 oz. quantity of such chips in a quantity of accelerant to coat the chips, and then adding this mixture to the package. This can be an advantageous method and embodiment of the disclosure as it is provides a waste diversion use for otherwise unwanted wood chips, utilizes a sufficiently small quantity of wood chips so as not to be a smoke emissions problem, and yet provides enough tinder material to ignite the rest of the package components, whether the firelog.

DETAILED DESCRIPTION OF DISCLOSURE

Figure 1A:
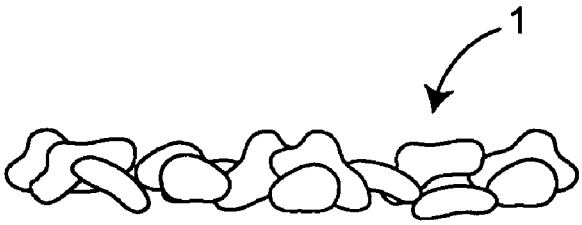
FIGS. 1–1D illustrate charcoal-derived tinder, charcoal chunks, inner covering and an outer covering of one embodiment.
Figure 1B:
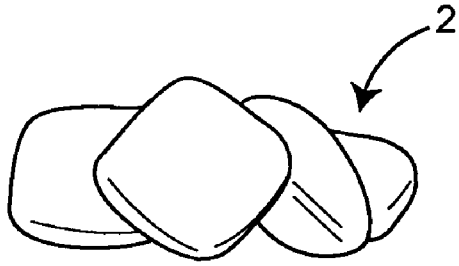
Figure 1C:
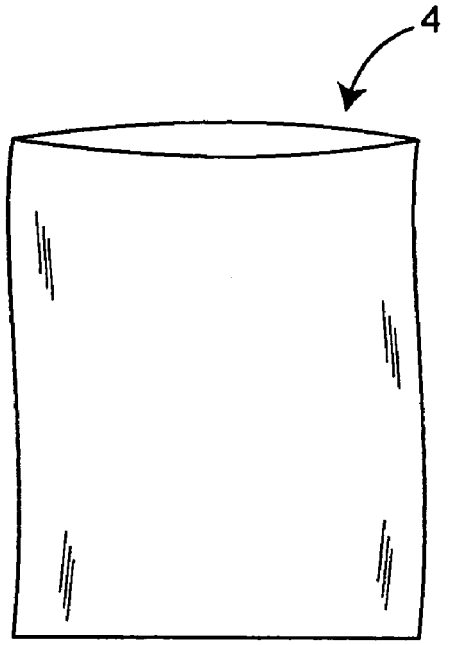

The Charcoal Fuel Package:

Referring to FIG. 1B, in one embodiment charcoal chunks 2 that are used as raw material consist of chunks of mesquite hardwood charcoal like those sold by Lazzari Fuel Company, San Francisco, Calif. Lump charcoal may be packaged in coverings containing different size pieces. Large pieces over about 3 inches in length are used as the charcoal 2. Smaller pieces are used as charcoal-derived tinder 1 as shown in FIG. 1A.

Small charcoal chunks ranging in size from one inch to about three inches in length are used as charcoal-derived tinder 1. If small chunks are not available they may be created by breaking up larger pieces of charcoal 2 with a mallet or similar device. Chunks smaller that about one inch may naturally occur and some amount of such smaller material may be permissible.

An all-natural vegetable wax made from soy may be used, such as Bitter Creek Candle Supply, Inc.'s "EZSoy" blend that is typically comprised of soy wax mixed with cottonseed oil. About ½ cup, or about 3.5 oz., of wax may be melted and applied to the charcoal-derived tinder 1 materials.

Figure 1D:
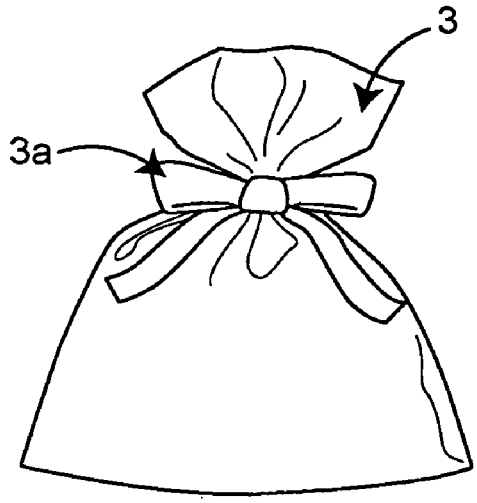

Referring to FIG. 1D, an outer covering 3 may be constructed from about a seven ounce weave of all-natural food-grade unprocessed burlap, as would be known to anyone familiar with the art in the field of such coverings or materials. The outer covering 3 may be in the form of a covering of dimensions about 18"×18" with one open end. The outer covering 3 may be tied with a drawstring 3*a* or functionally similar closure, about four inches from the top. The drawstring 3*a* may be made of all-natural jute twine or similar material. The ingredients may be combined, as further described below, in the covering as shown in FIGS. 2 and 6.

Figure 2:
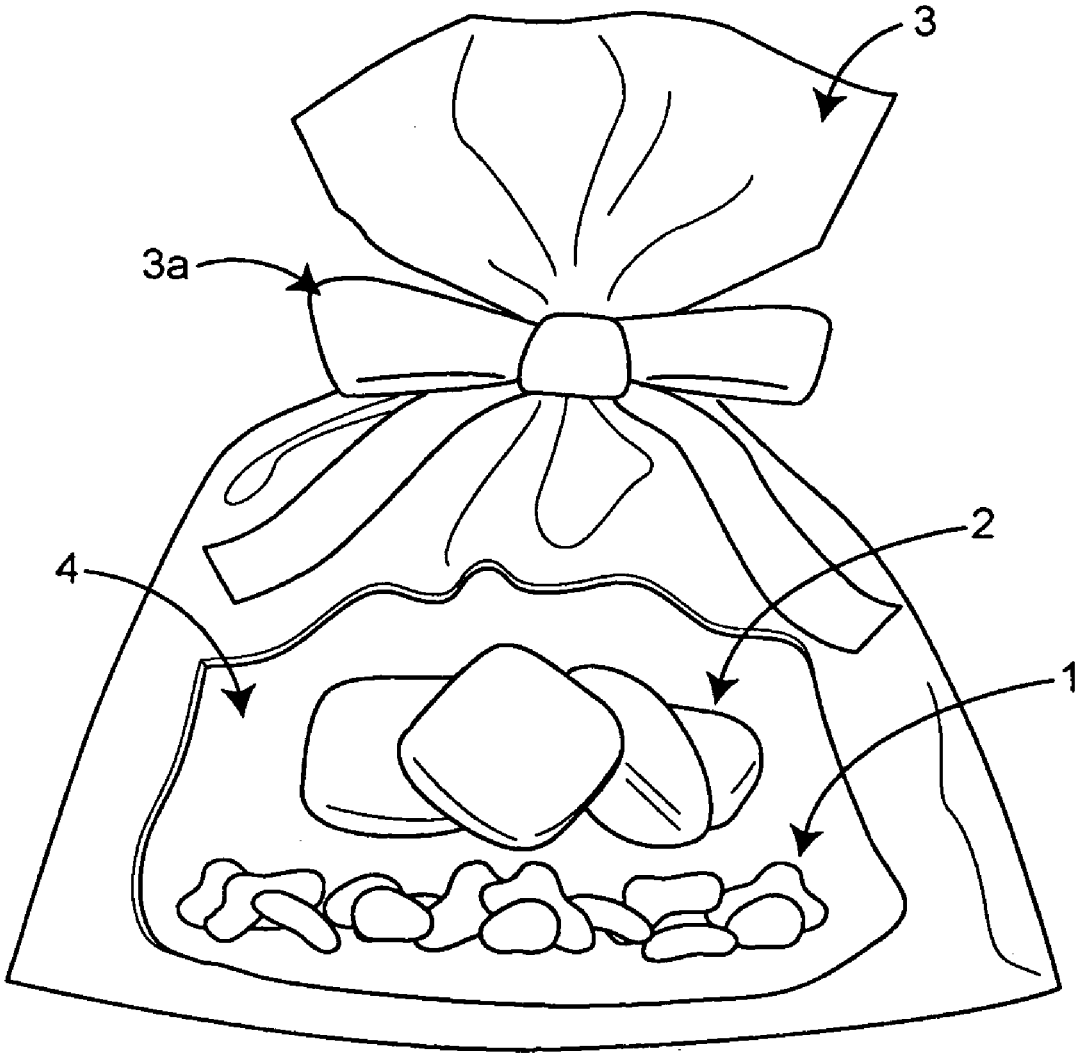
FIG. 2 is a plan view of the assembled embodiment of FIG. 1D with portions of the inner and outer coverings removed.

The inner covering 4 may be made from an all-cornstarch polymer material, known under the trade name of "Mater-bi." The dimensions of the inner covering 4 may be smaller than the outer covering 3 but large enough for the charcoal ingredients to be contained within it as shown best in FIG. 2.

Figure 6:
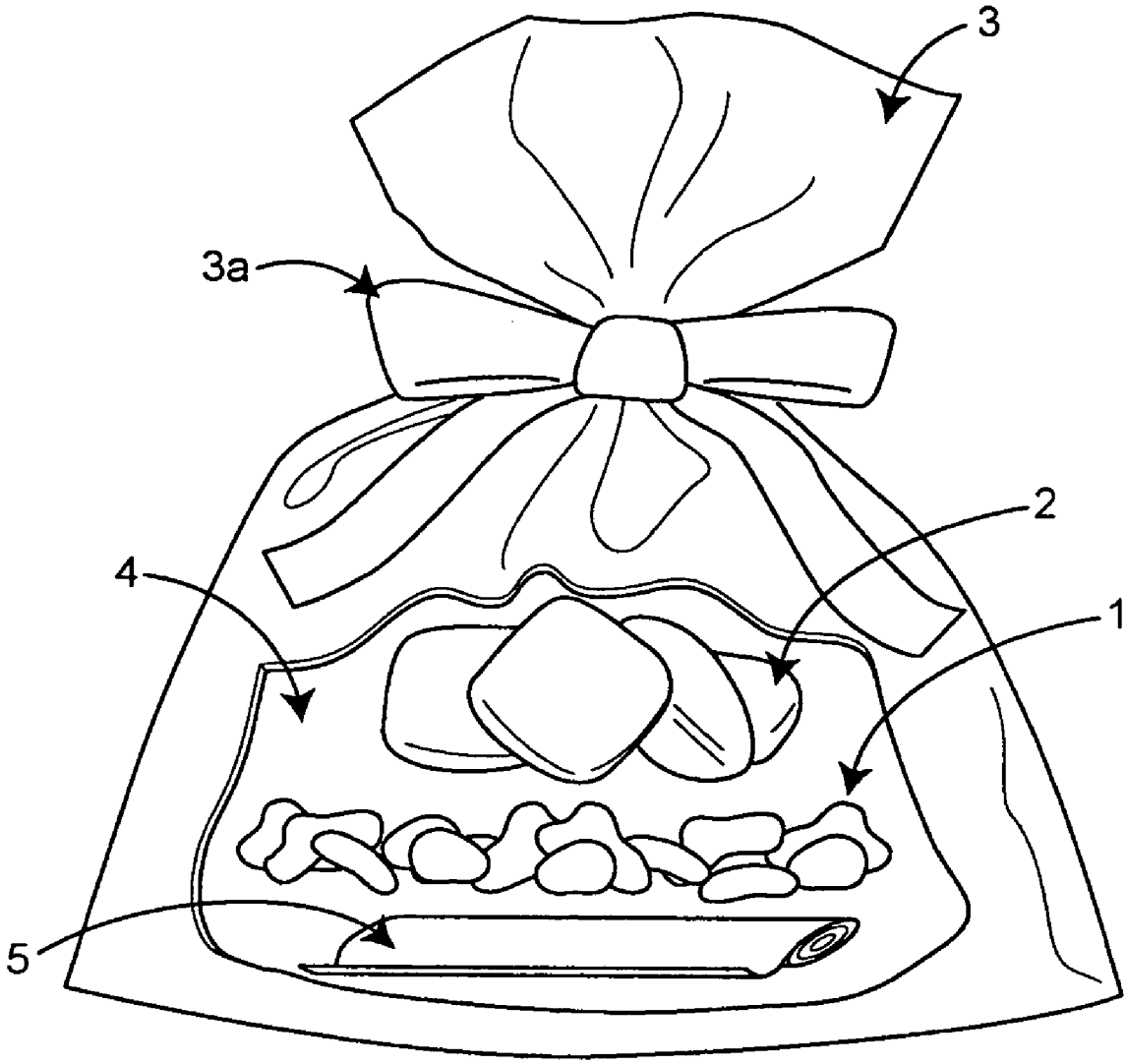
FIG. 6 is an alternative to the embodiment illustrated in FIG. 2.

Referring to FIG. 6, in an embodiment cloth wicking 5 may be used as tinder material. Natural-fiber material, such as jute or cotton, may be also used, in such amount as may be sufficient to hold the indicated amount of soy wax.

Referring to FIGS. 1A–D and FIG. 2, the package may be constructed as follows: About one pound of charcoal-derived tinder 1 may be obtained by taking small chunks of charcoal material as obtained from a charcoal supplier, and/or breaking large chunks into smaller ones.

Next, soy wax may be melted in a suitable melting apparatus, adhering to all safety and temperature guidelines of the manufacturer. In an embodiment, for small sample quantities, a "Crock Pot," stove-top double-boiler, or functionally similar equipment should be sufficient. In an embodiment, ½-cup or about 3.5 ounces by weight of Bitter Creek Candle Supply, Inc.'s "EZSoy" wax may be melted in order to provide the quantity of melted wax for making one complete package according to the method of the product.

Next, the charcoal-derived tinder 1 may be placed into a pan, and soy wax may be poured over the material so as to cover the outer surface uniformly with minimal omitted areas. This result may be achieved by pouring the soy wax over the charcoal-derived tinder 1 and then stirring. A stirring duration of about five seconds provides the coating without causing the soy wax to also soak excessively into the charcoal-derived tinder 1 and use more than an economical quantity. The resulting coated charcoal-derived tinder 1 may be allowed to cool partially in the pan.

Next, a complete package can be created, as follows: The wax-coated charcoal-derived tinder 1 may be inserted into the inner covering 4. The inner covering 4 may be then filled with remaining charcoal chunks 2 to the desired total weight, which in an embodiment is about five pounds.

The resulting inner covering 4 containing charcoal chunks 2 and charcoal-derived tinder 1 may then be inserted into the outer covering 3 which is then tied with a drawstring 3*a*, as shown in FIG. 2.

The result of this particular arrangement according to the methods of the disclosure provides a flammable product made from a clean-burning all-natural material, the outer covering 3, which when ignited further ignites small charcoal-derived tinder 1 appropriately prepared with clean-burning all-natural materials, being soy wax with cottonseed oil in an embodiment, and which are situated so as to provide enough sustained heat to finally ignite the charcoal chunks 2 materials.

In an embodiment in which wicking 5 may be a more economical or efficient method of manufacturing the product, FIG. 6 shows the schematic drawing of the placement of wicking 5 underneath charcoal-derived tinder 1. Before placement, the wicking 5 may be first soaked in the melted soy wax. A sufficient quantity of wicking 5 may be to be used so as to soak up all or most of the specified amount of soy wax. The charcoal-derived tinder 1 may be used with or without a soy wax coating. The package may be assembled by then placing the wicking 5 in the bottom of the inner covering 4, adding charcoal-derived tinder 1 into the inner covering 4 on top of the wicking 5, then adding charcoal chunks 2 to the desired total weight, which in an embodiment may be about five pounds.

The resulting inner covering 4 containing wicking 5, charcoal chunks 2 and charcoal-derived tinder 1 may then be inserted into the outer covering 3 which is then tied using the drawstring 3*a*, as shown in FIG. 6.

Figure 3A:
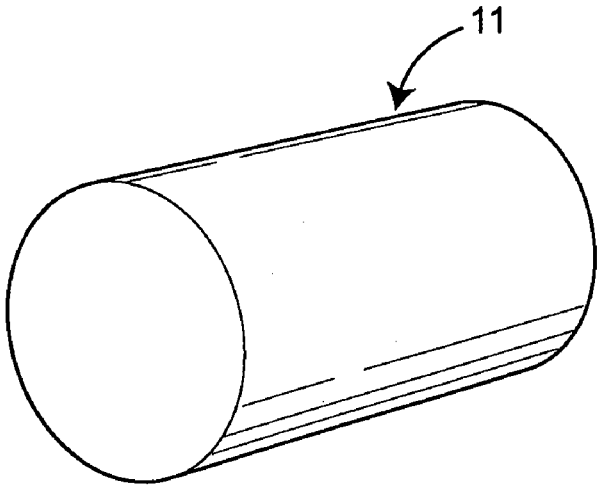
FIGS. 3A–3D illustrate a firelog, firelog-derived tinder, inner covering and outer covering of another embodiment.
Figure 4:
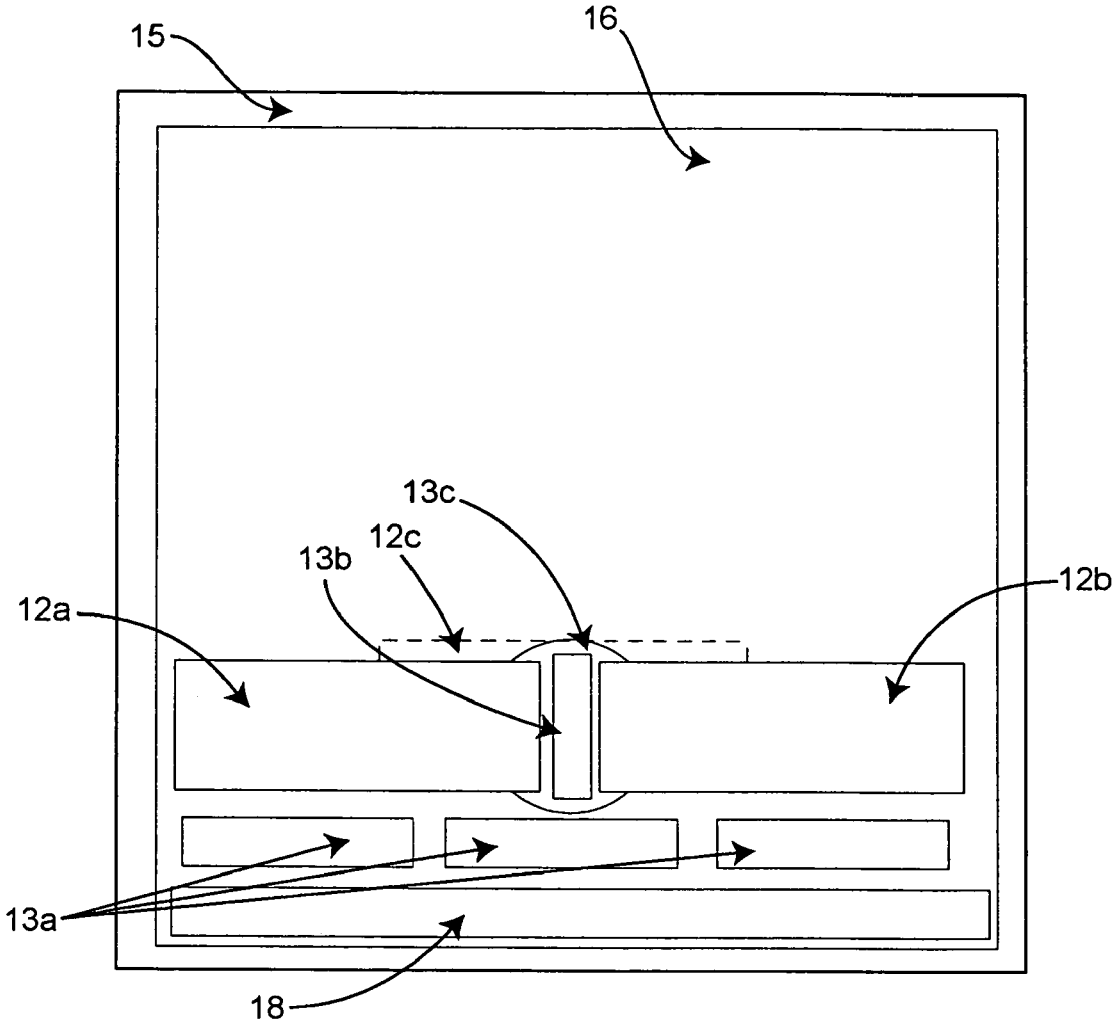
FIG. 4 is a sectional plan view of the assembled embodiment shown in FIGS. 3A–3D.
Figure 5:
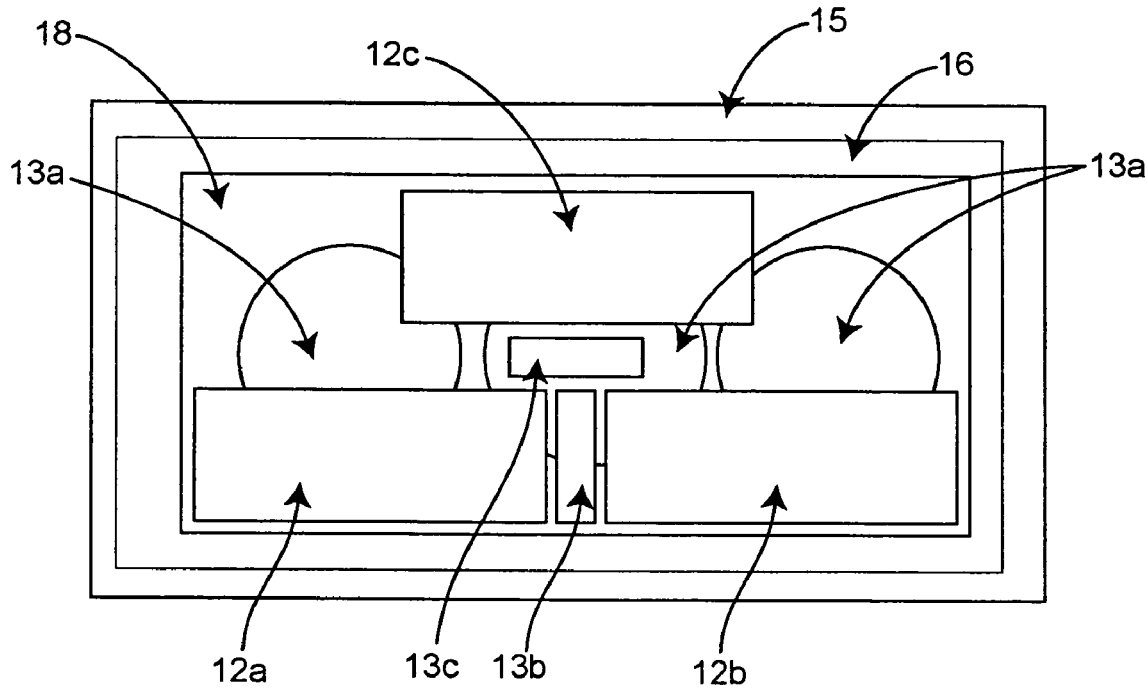
FIG. 5 is an alternative to the embodiment illustrated in FIG. 4.
Figure 7:
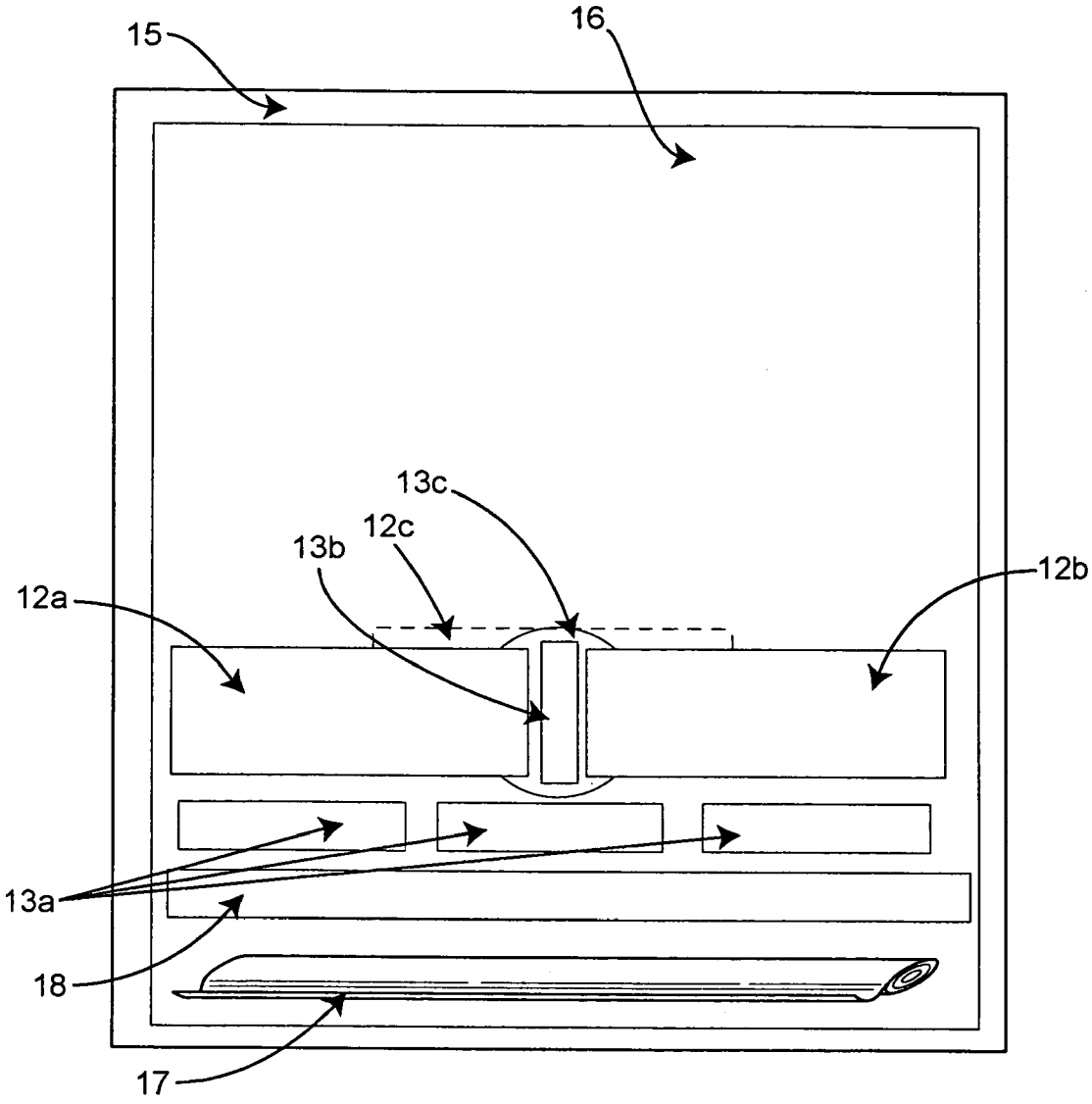
FIG. 7 is another alternative to the embodiment shown in FIG. 4.

The Firelog Fuel Package:

In the wood embodiment, the raw material used to construct the package may include a firelog 11 of compressed sawdust about four inches in diameter, and about 12 inches in length, as shown in FIG. 3A. Other dimensions are certainly possible. The material present in the firelog 11 may be wood chips, sawdust or other cellulosic fibers compressed together under sufficient heat and pressure. In an embodiment a representative firelog 11 may be like logs manufactured by West Oregon Wood Products, marketed under the name "High Energy Heat Logs." The firelogs 11 are packaged in the final product as three half firelogs 12*a*, 12*b* and 12*c* as shown in FIGS. 4, 5 and 7.

Figure 3B:
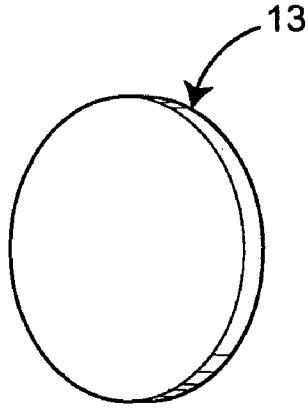

Firelog tinder material embodiments may include a firelog 11 chopped into tinder materials. A half portion of the tinder material may be comprised of chips, chunks, and some sawdust, and another half portion may be comprised of wafers 13 ranging in thickness from ¼ inch to about ½ inch as shown in FIG. 3B. Other dimensions are certainly possible. The material may be obtained from the firelog product 11 by using a hammer and chisel, chiseling off the desired-sized fragment until the specified quantity may be obtained, or a large-gauge nail may be used. Automated grinders may also be employed. An essential feature of the disclosure is that the firelog material itself provides the tinder material because it exhibits the burn characteristics of the firelog 11, e.g. a high-energy, high-temperature flame sufficient to ignite the main firelogs, and less wood smoke and other residue than natural wood tinder.

In an embodiment, an all-natural wax made from soy may be used such as Bitter Creek Candle Supply, Inc.'s Ecowax "EZSoy Blend". A one-half cup of wax is melted and applied to the firelog-derived tinder materials.

Figure 3C:
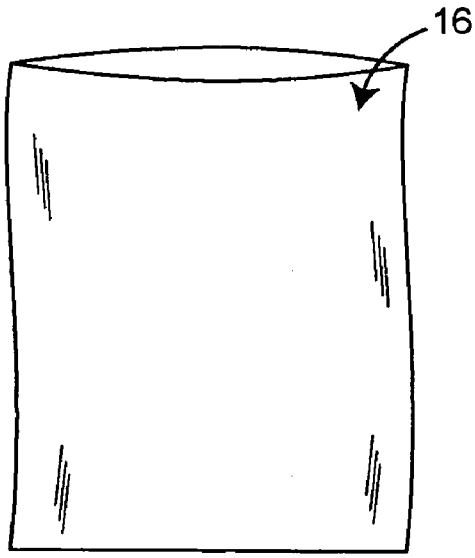
Figure 3D:
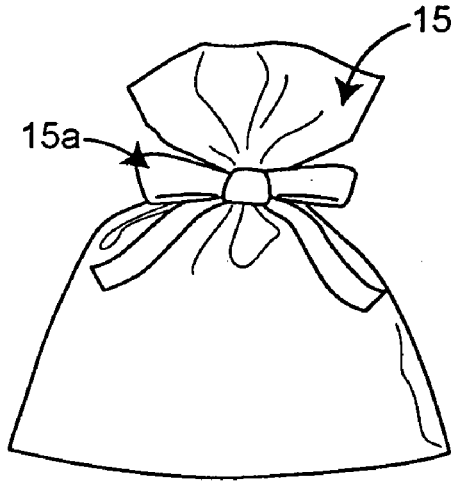

Referring to FIG. 3D, in an embodiment an outer covering 15 may be constructed from about 7 ounce weave all-natural food-grade unprocessed burlap, as would be known to one of ordinary skilled in the art of such coverings or materials. The outer covering 15 may be of dimensions about 18"×18" with one open end. The outer covering 15 may be tied with a drawstring 15*a* about four inches from the top. The drawstring 15*a* may be constructed of all-natural jute twine or other natural material. The ingredients may be combined, as further described below, in the outer covering 15.

Referring to FIG. 3C, in an embodiment the inner covering 16 may be constructed from an all-cornstarch polymer material, known under the trade name of "Mater-bi." The dimensions of the inner covering 16 should be smaller than the outer covering 15 but large enough for the wood fuel ingredients to be contained within it.

Referring to FIG. 7, in an embodiment cloth wicking 17 may be used as tinder material. Natural-fiber material, such as jute or cotton, may also be used in such amount sufficient to hold the desired amount of soy wax.

Referring to FIGS. 4 and 5, the firelog package may be constructed as follows: firelog-derived tinder may be obtained by chopping or chiseling small portions from a complete firelog 11. In an embodiment, a chisel or large-gauge nail may be used. Wafers 13 may be created in widths varying from ¼ to about ½ inch by placing the chisel or nail the corresponding distance from the end of the firelog 11 and striking firmly with a hammer or mallet. In this process, smaller chips, chunks, and sawdust may be thereby created. Smaller chips and sawdust may be deliberately created by placing the chisel or nail closer to the end of the firelog 11. Other methods of creating wafers 13 of firelog material or chips and chunks of firelog material may be used. In large-scale production embodiments, a mechanical apparatus may used to produce firelog-derived tinder, such as a jaw or cone grinder of the appropriate dimensions.

For a completed firelog package according to the disclosure, a quantity equal to about one half of a firelog 11 may be used to create the described firelog-derived tinder material. In an embodiment of the disclosure, the firelog-derived tinder material may consist of three or four wafers 13 of about ½ inch thickness, four to six wafers 13 of about ¼ inch thickness, and the remaining material consists of chips and fragments measuring between ½ and 1 square inch, and finer sawdust, in about equal parts. An embodiment may balance the needs for rapid production and the variability of the characteristics of the material, against the specific details of exact quantities of firelog-derived tinder used. It may be equally preferred, in the interests of economical production of the product, to vary the exact quantities within a small range, in order to minimize the effort of production. For example, if the variability in the composition of a specific firelog 11 may be such that when chopped or broken for the creation of firelog-derived tinder, the wafers 13 may more easily be comprised of two wafers 13 of about ¾ inch thickness, and three wafers 13 of about ½ inch, then economic production dictates that the material should be used in about those dimensions and quantities. An embodiment of the disclosure may be that the overall half firelog 12 may be used for firelog-derived tinder with about ½ by weight of the firelog-derived tinder comprised of wafers 13, and the remaining half comprised of chunks, chips, and sawdust.

Next, soy wax may be melted in a suitable melting apparatus, adhering to all safety and temperature guidelines of the manufacturer. In an embodiment, for small sample quantities, a "Crock Pot" or stove-top double-boiler may be sufficient. In an embodiment, ½-cup or about 3.5 ounces of Bitter Creek Candle Supply, Inc.'s "EZSoy" soy wax may be melted to provide the quantity of melted wax for making one complete package according to the methods disclosed.

Next, using appropriate tongs or an equivalent holder, the wafers 13 may be coated with the melted soy wax to cover the outer surfaces uniformly, with minimal missed spots. This may be achieved by immersion of the wafers 13 either mostly or completely in the melted soy wax. A short immersion may be sufficient to provide the coating required without causing the soy wax to soak into the materials and use more than an economical quantity. The wafers 13 may be set aside on non-absorbent material to cool. Once all the wafers 13 are so coated, the chip, fragment and sawdust materials may be added to the remaining melted soy wax. This mixture should soak up all the remaining soy wax, and then be set aside on a non-absorbent surface to cool. The cooled mixture will consist of the chips together with sawdust-and-wax clumps less than about ½ inch diameter in a loose aggregate 18. The reason for using non-absorbing cooling surfaces may be to prevent absorption of the molten wax from the material. An alternate embodiment may be to place the firelog-derived tinder 14 in a pan and pour the melted wax over the combination of wafers 13, chips, chunks and sawdust to achieve uniform coverage. The resulting combination with wax may be then mixed by hand until the desired amount of coverage may be obtained. The pan contents may then be allowed to cool.

Once all materials have cooled, a complete package can be created, as follows: Referring to FIG. 4, the aggregate 18 of chips and sawdust-wax clumps may be spread evenly across the bottom of the inside of the inner covering 16. Then the ¼ inch (nominal size) wafers 13*a* may be placed evenly-spaced across top of the aggregate 18.

Next, three half firelogs 12 may be placed according to the disclosed methods. These half firelogs 12 may be obtained by taking a firelog 11 and splitting the firelog 11 in half using the chisel or nail technique as described above.

Referring to FIG. 4, the half firelogs 12 may be placed as follows: two half firelogs 12*a* and 12*b* are placed end-to-end, on top of the layer of wafers 13*a*, and the layer of aggregate 18. A third half firelog 12*c* may be placed adjacent to the two half firelogs 12*a* and 12*b*, such that the midpoint of the third half firelog 12*c* may be adjacent to the joint where the two half firelogs 12*a* and 12*b* meet. Any remaining wafers 13 may be placed atop the set of three half firelogs. The arrangement is also shown in plan view of FIG. 5.

Referring to FIG. 5, a ½ inch (nominal size) wafer 13*b* may be placed between the two half firelogs 12*a* and 12*b* where they meet end-to-end. Another ½ inch wafer 13*c* may be placed between a third half firelog 12*c* and the adjacent two half firelogs 12*a* and 12*b*, at the midpoint, perpendicular in orientation to the orientation of the wafer 13*b* placed between the two half firelogs 12*a* and 12*b*. The placement of the wafers 13*b* and 13*c* may be chosen to provide airflow around the three half firelogs 12*a*, 12*b* and 12*c*. If airflow is constricted or inadequate, the firelog materials may not ignite and burn properly.

Any remaining wafers 13 may be placed atop the set of three half firelogs. The inner covering 16 may be placed inside the outer covering 15, which may then be tied with the drawstring 15*a* such that the materials so placed according to the disclosed methods are held in place sufficiently to prevent or minimize rearrangement. In an embodiment of the disclosure some variation in the exact placement of the half firelogs 12*a*, 12*b* and 12*c* and wafers 13*a* and 13*b* components may occur due to the irregular-shaped nature of the material and the wrapping.

Referring to FIG. 7, in another embodiment wicking 17 may be a more economical or efficient method of manufacturing the product. FIG. 7 shows wicking 17 underneath aggregate 18. In this embodiment, the aggregate 18 may consist of the chip, chunk, and sawdust material as disclosed, but may not be soaked with soy wax. Before placement, the wicking 17 may be first soaked in the melted soy wax. A sufficient quantity of wicking 17 may be used to soak up all the specified amount of soy wax. The package may be assembled by then placing the wicking 17 in the bottom of the inner covering 16, and adding unwaxed aggregate 18 on top of the wicking 17. Accordingly, the ¼ inch (nominal size) wafers 13*a* may be placed evenly-spaced across top of the aggregate 18.

Next, three half firelogs 12*a*, 12*b* and 12*c* may be placed according to the disclosed methods. These half firelogs 12*a*, 12*b* and 12*c* may be obtained by taking a firelog 11 and splitting it in half using the chisel or nail technique as disclosed above. The half firelogs 12*a*, 12*b* and 12*c* may be placed as follows: two half firelogs 12*a* and 12*b* may be placed end-to-end, on top of the layer of wafers 13*a*, and the layer of aggregate 18. The third half firelog 12*c* may be placed adjacent to the two half firelogs 12*a* and 12*b*, such that the midpoint of the third half firelog 12*c* may be adjacent to the joint where the two half firelogs 12*a* and 12*b* meet.

The need to make the product economical may be balanced with the need to position the components as to provide for easy ignition of the tinder material and sufficient airflow within the package. Accordingly in an embodiment of the disclosure, some variation in the placement of components may occur in the interest of saving manufacturing time, so long as the placement affords the necessary airflow.

The result of these disclosed methods and apparatuses provide a flammable product made from a clean-burning all-natural material, which when ignited also further ignites layers of tinder appropriately prepared with clean-burning all-natural materials selected so as to provide enough sustained heat to finally ignite the larger chips and ultimately the main firelog materials.

What is claimed:

1. A combustible fuel package, comprising:

a plurality of pieces of charcoal material of first, second, and third sizes, the first size being larger than the second size, the second size being larger than the third size, wherein a combustible coating is combined with charcoal pieces consisting of the third size pieces of charcoal material; and an outer wrapper of combustible material enclosing the plurality of pieces of charcoal material and quantity of the combustible coating.

2. The combustible fuel package of claim 1, wherein the wrapper combustible material is burlap.

3. The combustible fuel package of claim 1, wherein the second and third size pieces and the combustible coating are contained within an inner wrapper, the inner wrapper being disposed within the outer wrapper, the inner wrapper comprising a combustible material.

4. The combustible fuel package of claim 3, wherein the combustible material of the inner wrapper is selected from the group consisting of cornstarch, burlap and paper.

5. The combustible fuel package of claim 1, further includes a wicking material placed proximate the plurality of pieces of charcoal.

6. The combustible fuel package in claim 5, wherein the wicking material contains vegetable wax.

7. The combustible fuel package of claim 1, wherein the combustible coating comprises a vegetable wax.

8. The combustible fuel package of claim 7, wherein the vegetable wax is a soybean wax.

9. A combustible fuel package, the combustible fuel package being substantially free of petroleum accelerants comprising:

a plurality of pieces of charcoal material of first, second, and third sizes, the first size being larger than the second size, the second size being larger than the third size;

a combustible coating, applied to charcoal pieces consisting of a portion of the third size pieces;

an inner wrapper enclosing the plurality of pieces and the combustible coating, the inner wrapper being made of a combustible material selected from the group consisting of cornstarch, burlap and paper;

an outer wrapper of woven combustible material, the outer wrapper enclosing the plurality of pieces of charcoal material, the combustible coating, and the inner wrapper.

10. The combustible fuel package of claim 9, wherein the woven combustible material is burlap.

11. The combustible fuel package of claim 9, further including a wicking material proximate the plurality of pieces of charcoal material.

12. The combustible fuel package in claim 11, wherein the wicking material contains vegetable wax.

13. The combustible fuel package of claim 9, wherein the combustible coating comprises a vegetable wax.

14. The combustible fuel package of claim 13, wherein the vegetable wax is a soybean wax.

15. A method of manufacturing combustible fuel package, the method comprising:

providing a plurality of pieces of charcoal material of first, second, and third sizes, the first size being larger than the second size, the second size being larger than the third size;

coating charcoal pieces consisting of third size pieces of charcoal material with a combustible coating;

placing the third size pieces of charcoal material with the combustible coating and the second size pieces and the first size pieces of charcoal material in an inner wrapper of combustible material;

placing the inner wrapper, within an outer wrapper of combustible material; and closing the outer wrapper so that the plurality of pieces of charcoal material, the inner wrapper and the combustible coating are enclosed therein.

16. The method of claim 15, wherein the combustible coating comprises a vegetable wax and the method further comprises melting the vegetable wax prior to coating the small pieces of charcoal material with the vegetable wax.

17. The method of claim 15, further including adding a wicking material into the inner wrapper.

* * * * *